US009856753B2

(12) United States Patent
Chow et al.

(10) Patent No.: US 9,856,753 B2
(45) Date of Patent: Jan. 2, 2018

(54) INNER DIAMETER SCALLOP CASE FLANGE FOR A CASE OF A GAS TURBINE ENGINE

(71) Applicant: UNITED TECHNOLOGIES CORPORATION, Hartford, CT (US)

(72) Inventors: Wai Tuck Chow, Singapore (SG); Oleg Ivanov, Granby, CT (US); Ron I Prihar, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 271 days.

(21) Appl. No.: 14/735,299

(22) Filed: Jun. 10, 2015

(65) Prior Publication Data

US 2016/0363004 A1 Dec. 15, 2016

(51) Int. Cl.
*F01D 25/24* (2006.01)
*F01D 25/14* (2006.01)

(52) U.S. Cl.
CPC ..... *F01D 25/243* (2013.01); *F01D 25/145* (2013.01); *F01D 25/24* (2013.01); *F01D 25/246* (2013.01); *F05D 2220/32* (2013.01); *F05D 2240/15* (2013.01); *F05D 2250/611* (2013.01)

(58) Field of Classification Search
CPC ..... F01D 25/243; F01D 25/145; F01D 25/24; F01D 25/246; F05D 2220/32; F05D 2240/15; F05D 2250/611
USPC ..... 415/214.1
See application file for complete search history.

(56) References Cited

U.S. PATENT DOCUMENTS 1,341,969 A * 6/1920 Breul ..... E05B 1/0007 16/DIG. 30
2,650,552 A * 9/1953 Wood ..... A21C 3/021 108/138
3,068,026 A * 12/1962 McKamey ..... F16L 39/005 285/123.1
3,746,374 A * 7/1973 Sedgwick ..... F16J 15/02 285/187

(Continued)

FOREIGN PATENT DOCUMENTS

EP 1749974 A2 2/2007
EP 2469043 A2 6/2012
WO 2015047495 A2 4/2015

OTHER PUBLICATIONS

European Extended Search Report dated Oct. 25, 2016, issued in the corresponding European Patent Application No. 16174009.7.

*Primary Examiner* — William McCalister
(74) *Attorney, Agent, or Firm* — Bachman & LaPointe, P.C.

(57) ABSTRACT

A case for a gas turbine engine incudes a radial flange with a partial scallop along an inner diameter of the radial flange. A case assembly for a gas turbine engine incudes a first case with a first radial flange with a partial scallop along an inner diameter of the first radial flange, the partial scallop adjacent to a first aperture through the first radial flange and a second case with a second radial flange with a second aperture through the second radial flange, the second radial flange mountable to the first radial flange at an interface such that the second aperture is axially aligned with the first aperture and a seal lip that extends from the second case interfaces with said first case at a longitudinal interface.

14 Claims, 9 Drawing Sheets

(56) References Cited

U.S. PATENT DOCUMENTS 4,552,386 A * 11/1985 Burchette ..... F16L 23/24 285/187
4,643,047 A * 2/1987 Distin ..... F16H 25/06 475/168
4,840,026 A * 6/1989 Nash ..... F01D 25/265 285/330
5,230,540 A * 7/1993 Lewis ..... F02K 1/80 285/363
5,288,206 A * 2/1994 Bromann ..... F01D 11/24 415/209.2
5,353,674 A * 10/1994 Volpp ..... G10D 13/02 84/411 R
5,411,369 A * 5/1995 Bouchard ..... F01D 25/246 415/189
5,437,482 A * 8/1995 Curtis ..... F16L 23/028 285/148.13
5,645,363 A * 7/1997 Dafforn ..... B60K 17/28 403/3
6,364,606 B1 4/2002 Rice et al.
6,658,853 B2 * 12/2003 Matsuda ..... F01D 9/023 60/753
6,752,592 B2 6/2004 Mohammed-Fakir et al.
8,092,164 B2 1/2012 Moon et al.
8,197,186 B2 6/2012 Dong et al.
8,206,102 B2 6/2012 Moon
8,257,039 B2 9/2012 Rose
8,393,855 B2 3/2013 Dong et al.
8,443,514 B2 5/2013 Bertino
8,459,941 B2 * 6/2013 Jasko ..... F01D 9/041 285/122.1
8,596,969 B2 * 12/2013 Chuong ..... F01D 25/246 415/209.2
8,596,972 B2 12/2013 Moon
8,726,675 B2 * 5/2014 Keith ..... F01D 25/243 60/796
8,899,051 B2 12/2014 Rice et al.
2009/0180864 A1 7/2009 Alvanos et al.
2010/0152729 A1 * 6/2010 Gallo, Sr. ..... A61B 18/148 606/41
2014/0133976 A1 * 5/2014 Remy ..... F01D 25/243 415/213.1
2015/0143813 A1 * 5/2015 Salunkhe ..... F01D 25/30 60/796
2015/0143814 A1 * 5/2015 Orosa ..... F01D 25/30 60/796
2015/0143816 A1 * 5/2015 Salunkhe ..... F02K 1/04 60/796
2015/0167498 A1 * 6/2015 Todorovic ..... F01D 21/045 415/214.1

* cited by examiner

INNER DIAMETER SCALLOP CASE FLANGE FOR A CASE OF A GAS TURBINE ENGINE

BACKGROUND

The present disclosure relates to a gas turbine engine and, more particularly, to a case flange therefor.

An engine case assembly for a gas turbine engine includes multiple cases that are secured to one to another at an external flange joint. The multiple cases facilitate installation of various internal gas turbine engine components such as a diffuser assembly, rotor assemblies, vane assemblies, combustors, seals, etc. Each external flange joint includes flanges that extend radially outwardly from an outer surface of the outer engine case.

The multiple external bolted flange joints have a specific fatigue life and may provides a potential leak path.

SUMMARY

A case for a gas turbine engine according to one disclosed non-limiting embodiment of the present disclosure can include a radial flange with a partial scallop.

A further embodiment of the present disclosure may include, wherein the partial scallop is along an inner diameter of the radial flange of an outer engine case.

A further embodiment of any of the embodiments of the present disclosure may include, wherein the partial scallop is along an outer diameter the radial flange of an inner engine case.

A further embodiment of any of the embodiments of the present disclosure may include, wherein the partial scallop forms a radius of about 0.25 inch (6.35 mm).

A further embodiment of any of the embodiments of the present disclosure may include, wherein the partial scallop forms an inner radius of about 0.25 inch (6.35 mm) formed from a face of the radial flange portion.

A further embodiment of any of the embodiments of the present disclosure may include a scallop along an outer diameter of the radial flange.

A further embodiment of any of the embodiments of the present disclosure may include, wherein the scallop forms a radius of about 0.25 inch (6.35 mm).

A further embodiment of any of the embodiments of the present disclosure may include, wherein the partial scallop forms a radius of about 0.25 inch (6.35 mm).

A further embodiment of any of the embodiments of the present disclosure may include, wherein a circle defined around an aperture in the radial flange tangentially interfaces with the inner diameter of the radial flange, the outer diameter of the radial flange, the partial scallop and the scallop.

A further embodiment of any of the embodiments of the present disclosure may include, wherein a web thickness around an aperture in the radial flange is approximately equivalent with respect to the inner diameter of the radial flange, the outer diameter of the radial flange, the partial scallop and the scallop.

A case assembly for a gas turbine engine according to another disclosed non-limiting embodiment of the present disclosure can include a first case with a first radial flange with a partial scallop along an inner diameter of the first radial flange, the partial scallop adjacent to a first aperture through the first radial flange; and a second case with a second radial flange with a second aperture through the second radial flange, the second radial flange mountable to the first radial flange at an interface such that the second aperture is axially aligned with the first aperture and a seal lip that extends from the second case interfaces with said first case at a longitudinal interface.

A further embodiment of any of the embodiments of the present disclosure may include, wherein the seal lip that extends from the second case includes an undercut adjacent to the longitudinal interface.

A further embodiment of any of the embodiments of the present disclosure may include, wherein a web thickness around an aperture in the radial flange is approximately equivalent with respect to the inner diameter of the first radial flange, an outer diameter of the first radial flange, and the partial scallop.

A further embodiment of any of the embodiments of the present disclosure may include a scallop along an outer diameter of the radial flange.

A further embodiment of any of the embodiments of the present disclosure may include, wherein the scallop forms a radius of about 0.25 inch (6.35 mm).

A further embodiment of any of the embodiments of the present disclosure may include, wherein the partial scallop forms a radius of about 0.25 inch (6.35 mm).

A further embodiment of any of the embodiments of the present disclosure may include, wherein the partial scallop forms an inner radius of about 0.25 inch (6.35 mm) formed from a face of the radial flange portion.

A further embodiment of any of the embodiments of the present disclosure may include, wherein a circle defined around the first aperture in the first radial flange tangentially interfaces with the inner diameter of the radial flange, the outer diameter of the radial flange, and the partial scallop.

A further embodiment of any of the embodiments of the present disclosure may include a heat shield that includes a distal end that interfaces with a step in the first case forward of the radial flange interface.

A further embodiment of any of the embodiments of the present disclosure may include a fastener with a "D" head that is received through the first and second aperture.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
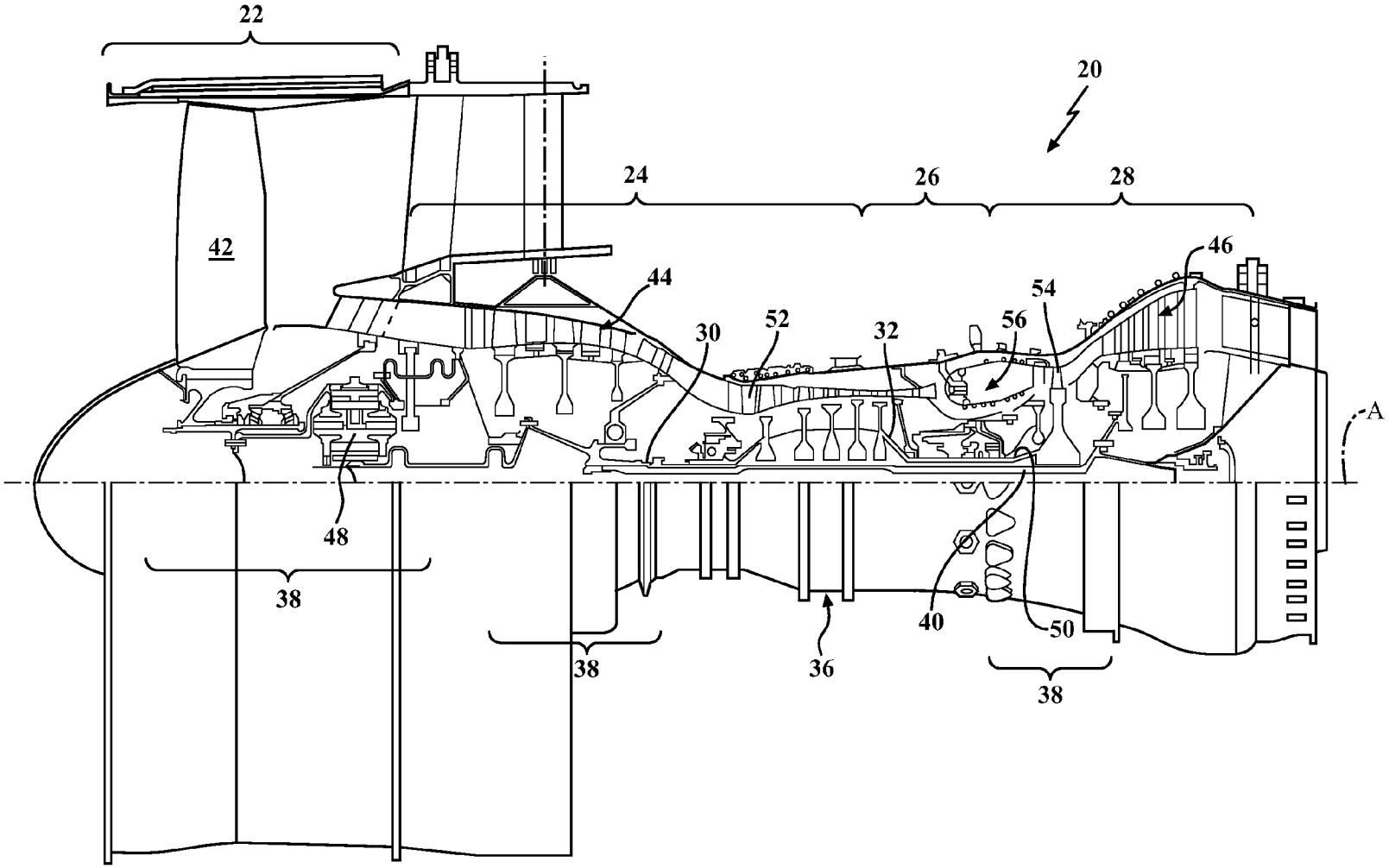
FIG. 1 is a schematic cross-sectional view of an example geared architecture gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines architectures such as a low-bypass turbofan may include an augmentor section (not shown) among other systems or features. Although schematically illustrated as a turbofan in the disclosed non-limiting embodiment, it should be understood that the concepts described herein are not limited to use with turbofans as the teachings may be applied to other types of turbine engines to include, but not limited to, a three-spool (plus fan) engine as well as other engine architectures such as turbojets, turboshafts, open rotors and industrial gas turbines.

The fan section 22 drives air along a bypass flowpath and a core flowpath. The compressor section 24 compresses air along the core flowpath for communication into the combustor section 26 then expansion through the turbine section 28. The engine 20 generally includes a low spool 30 and a high spool 32 mounted for rotation about an engine central longitudinal axis A relative to an engine case assembly 36 via several bearing compartments 38.

The low spool 30 generally includes an inner shaft 40 that interconnects a fan 42, a low-pressure compressor ("LPC") 44 and a low-pressure turbine ("LPT") 46. The inner shaft 40 drives the fan 42 either directly or through a geared architecture 48 to drive the fan 42 at a lower speed than the low spool 30. The high spool 32 includes an outer shaft 50 that interconnects a high-pressure compressor ("HPC") 52 and high-pressure turbine ("HPT") 54. A combustor 56 is arranged between the HPC 52 and the HPT 54. Core airflow is compressed by the LPC 44 then the HPC 52, mixed with fuel and burned in the combustor 56, then expanded over the HPT 54 and the LPT 46. The HPT 54 and the LPT 46 drive the respective high spool 32 and low spool 30 in response to the expansion. The inner shaft 40 and the outer shaft 50 are concentric and rotate about the engine central longitudinal axis A that is collinear with their longitudinal axes.

In one example, the gas turbine engine 20 is a high-bypass geared architecture engine in which the bypass ratio is greater than about six (6:1). The geared architecture 48 can include an epicyclic gear system 48, such as a planetary gear system, star gear system or other system. The example epicyclic gear train has a gear reduction ratio of greater than about 2.3, and in another example is greater than about 2.5 with a gear system efficiency greater than approximately 98%. The geared turbofan enables operation of the low spool 30 at higher speeds which can increase the operational efficiency of the LPC 44 and LPT 46 and render increased pressure in a fewer number of stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one non-limiting embodiment, a significant amount of thrust is provided by the bypass flow due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$ in which "T" represents the ambient temperature in degrees Rankine. The Low Corrected Fan Tip Speed according to one non-limiting embodiment of the example gas turbine engine 20 is less than about 1150 fps (351 m/s).

Figure 2:
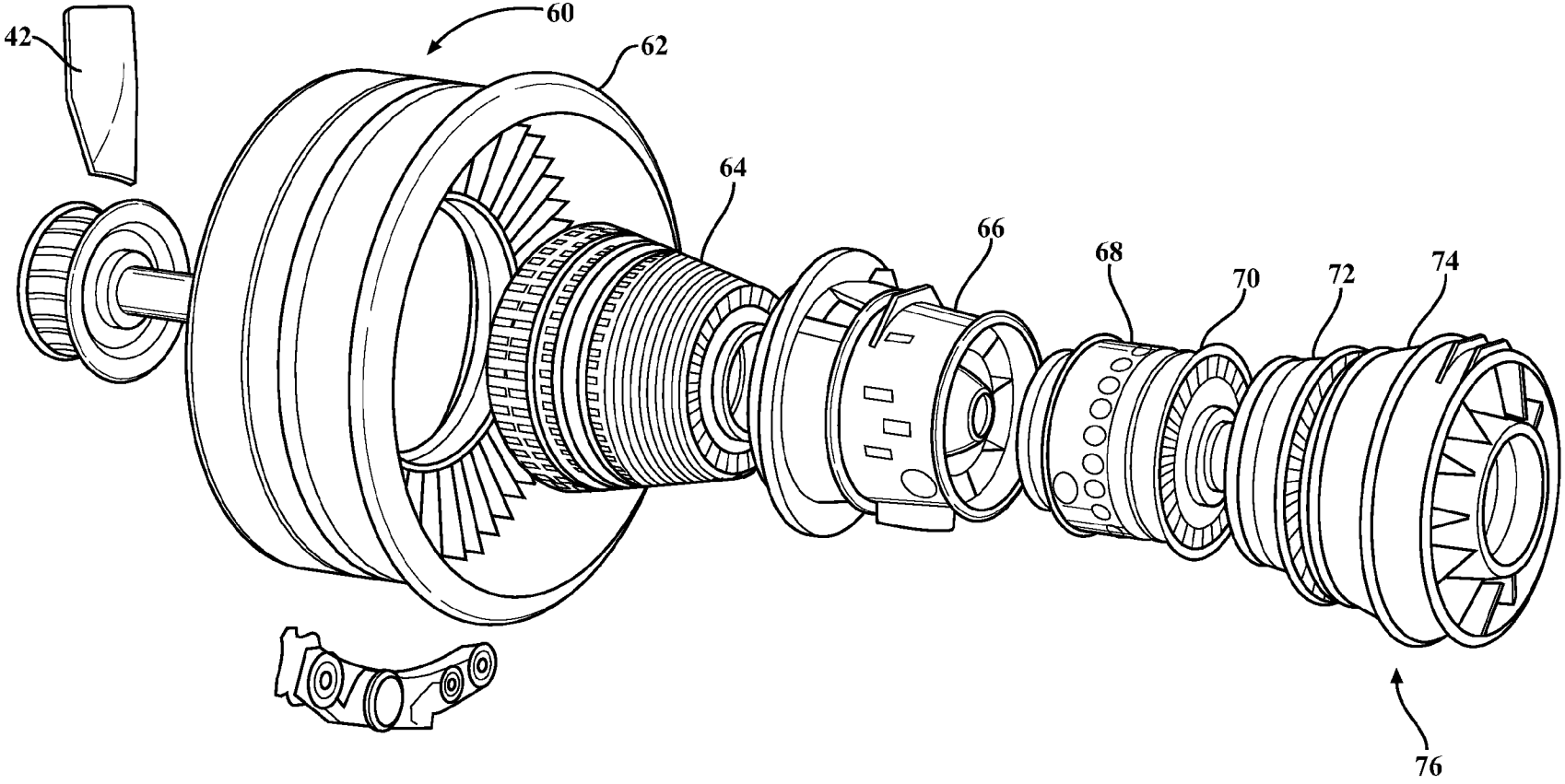
FIG. 2 is an exploded view of an engine case assembly of the example geared architecture gas turbine engine.

With reference to FIG. 2, the engine case assembly 36 generally includes a plurality of cases, including a fan case 60, an intermediate case 62, a Low Pressure Compressor (LPC) case 64, a High Pressure Compressor (HPC) case 66, a diffuser case 68, a High Pressure Turbine (HPT) case 70, a mid-turbine frame (MTF) case 72, a Low Pressure Turbine (LPT) case 74, and a Turbine Exhaust Case (TEC) case 76. It should be appreciated that additional or alternative cases might be utilized.

Figure 3:
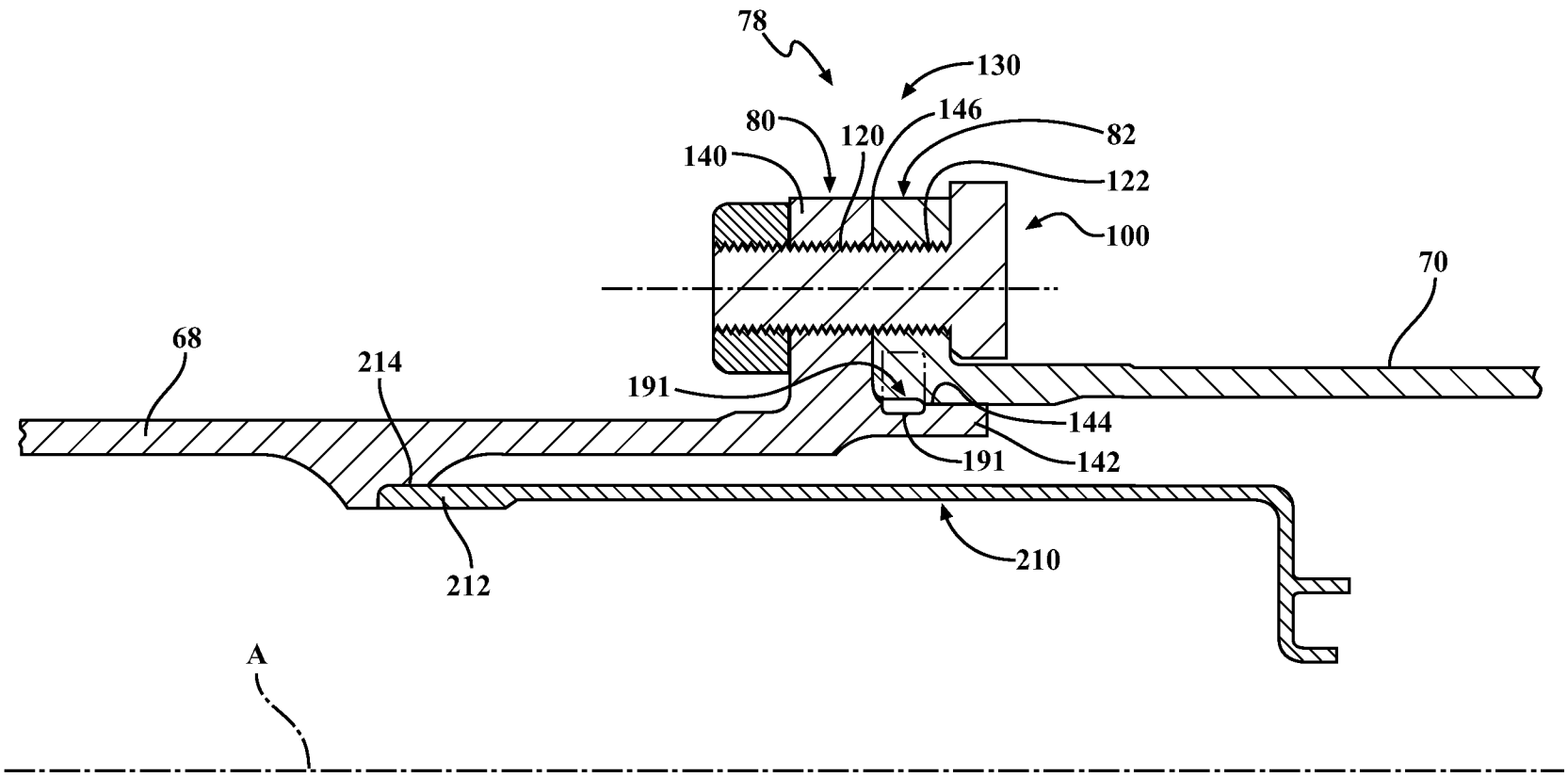
FIG. 3 is a cross-sectional view through an example case flange.

With reference to FIG. 3, each case is assembled to an adjacent case at a respective flange 80, 82, via a plurality of fasteners 100 (one shown) that are installed in respective apertures 120, 122 to form flanged joint 78. It should be appreciated that although a single flange joint interface 130 between an example diffuser flange 80, of the diffuser case 68 and an adjacent HPT flange 82 of the HPT case 70 are illustrated in this example, any flange joint interface 130 such as between each or any of the above delineated cases will benefit herefrom.

Figure 6:
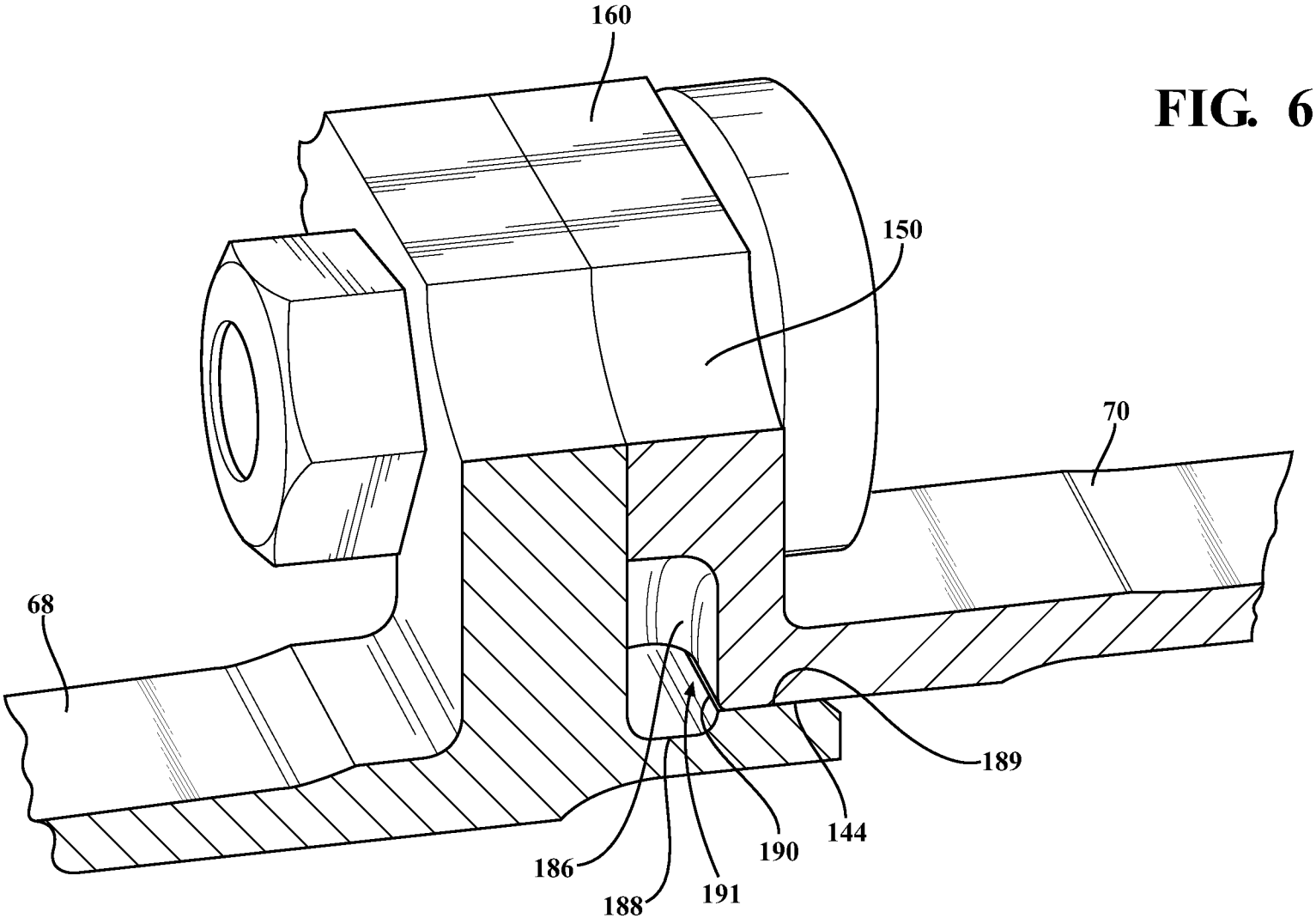
FIG. 6 is a sectional perspective view of the flange joint.
Figure 7:
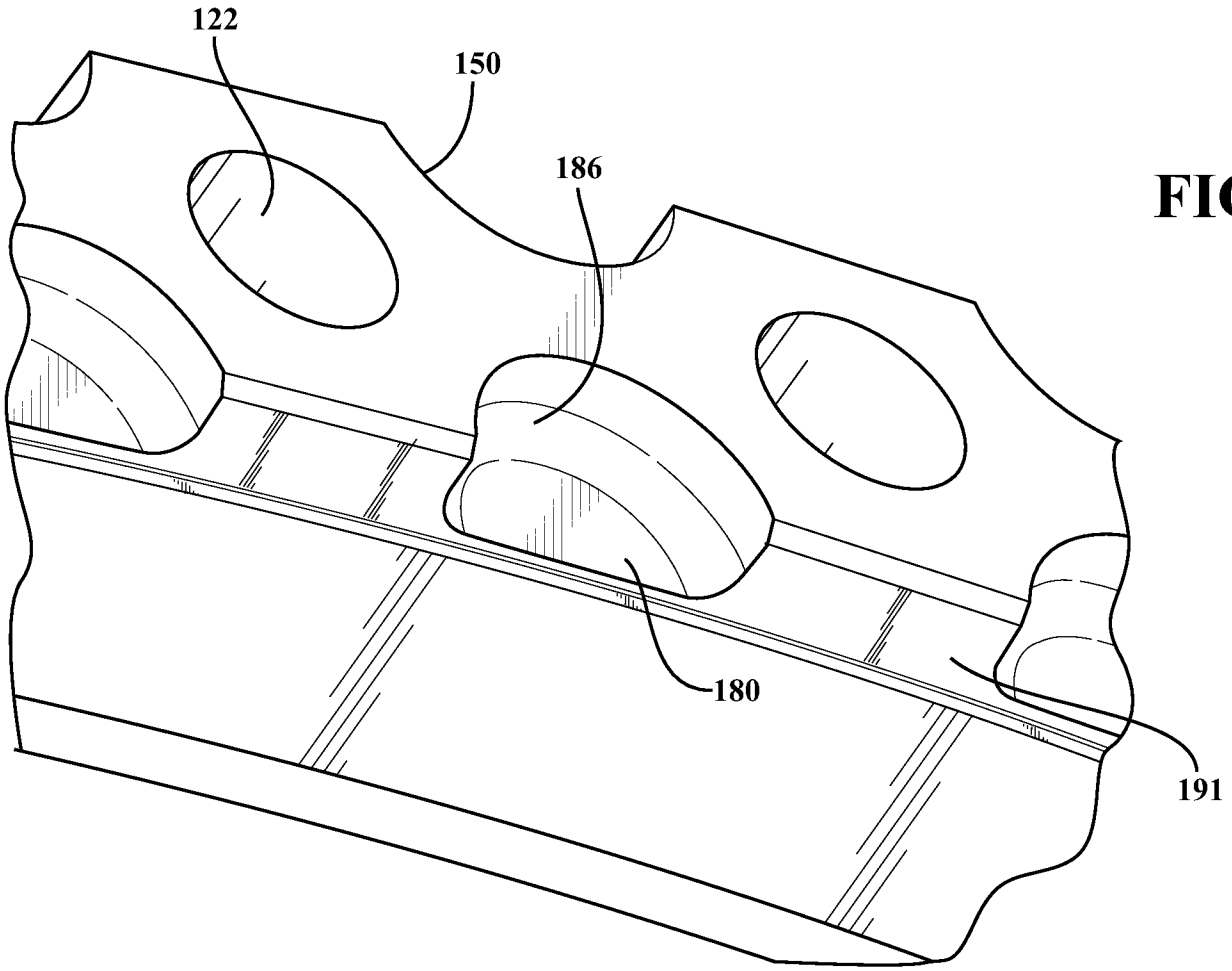
FIG. 7 is a perspective view of a fillet radius at the partial scallop.

The diffuser flange 80 generally includes a radial flange portion 140 and a seal lip 142 that extend transverse thereto. In this embodiment, the seal lip 142 extends longitudinally with respect to the engine axis A and is perpendicular to the radial flange portion 140. The seal lip 142 is arranged to at least partially overlap the HPT case 70 and is directed in a downstream direction to interface with the HPT case 70 at a longitudinal interface 144 to seal a radial interface 146 between the flanges 80, 82. That is, the longitudinal interface 144 extends axially beyond the radial interface 146. The seal lip 142 may include an undercut 188 to ensure the seal snap occurs on the uninterrupted (in circumferential direction) surface 189 (FIG. 6). Alternatively, or in addition, an undercut 191 may be located on the flange 82 (FIG. 7).

In one example, the radial flange portion 140 defines a thickness of about 0.26 inch (6.6 mm). Such a thickness facilitates coating repair, such as via plasma spray, which may be required whenever the diffuser case 68 and the HPT cases 70 are separated.

In this disclosed non-limiting embodiment, a heat shield 210 includes a distal end 212 that interfaces with a step 214 in the diffuser case 68 forward of the radial flange portion 140. The interface location of the heat shield 210 thereby facilitates shielding of the radial interface 146 from high speed/high pressure flow to minimize heat transfer at flange. That is, the heat shield 210 is radially inboard of the seal lip 142.

Figure 4A:
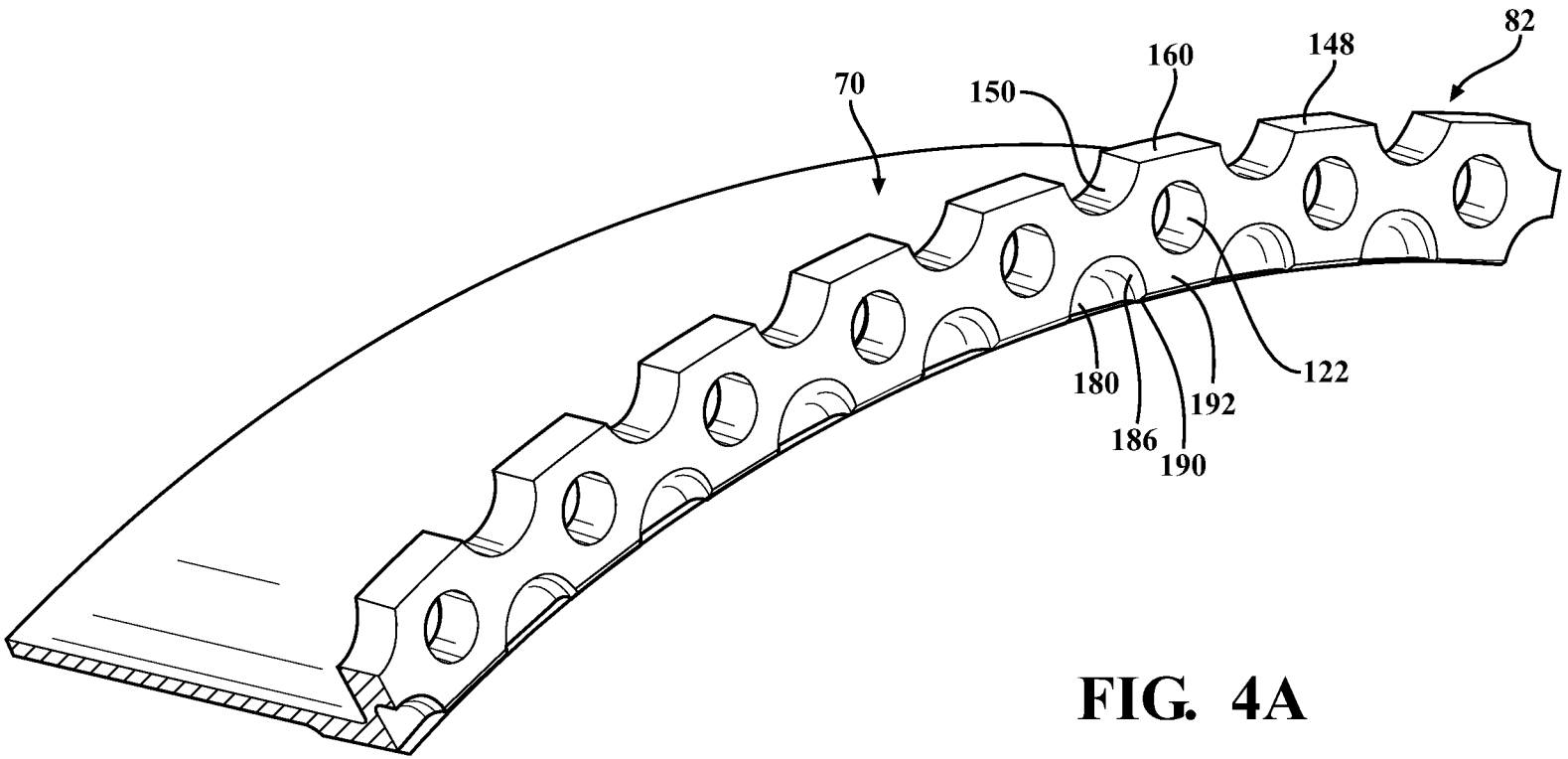
FIG. 4A is a perspective view of a flange for an outer case.

With reference to FIG. 4A, a radial flange portion 148 includes a scallop 150 along an outer diameter 160 to flank each aperture 122. This facilitates a reduction of the stress on the aperture 122 near the outer diameter 160. Each aperture

Figure 4B:
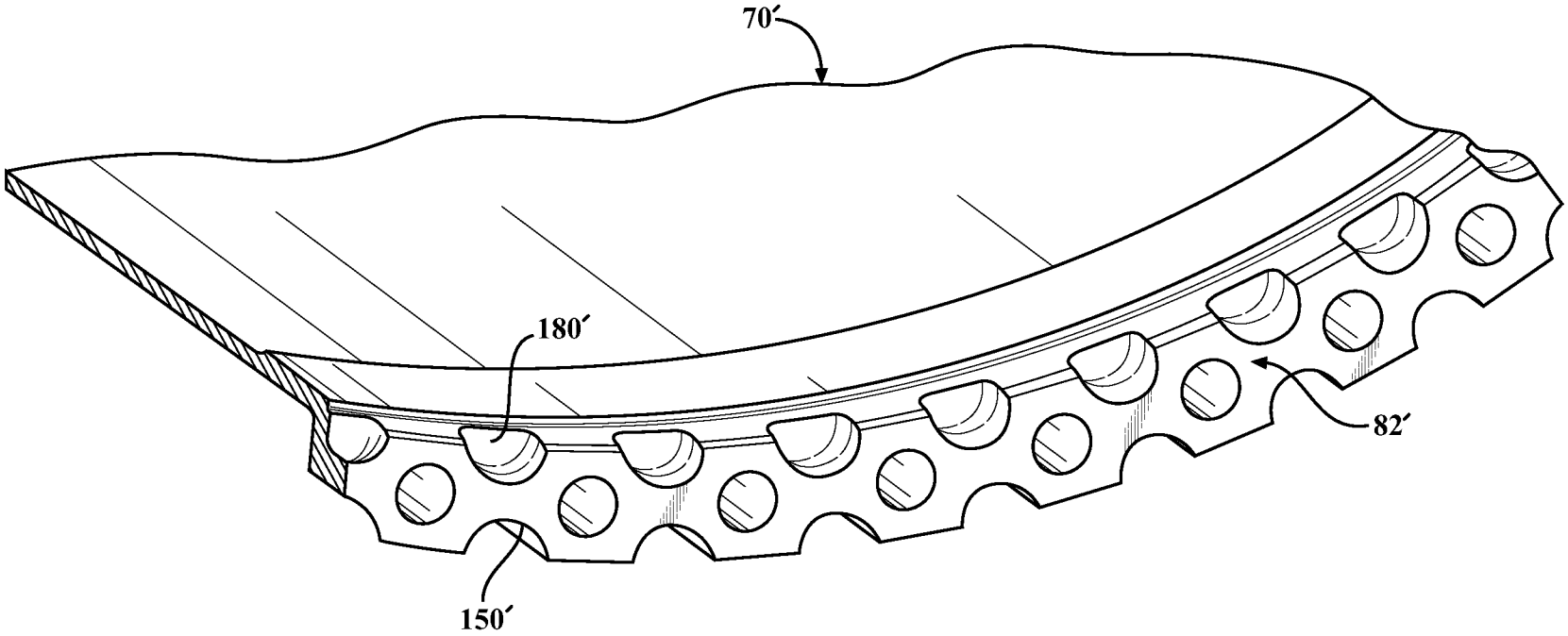
FIG. 4B is a perspective view of a flange for an inner case.

120, 122, in one example, is about 0.34 inch (8.6 mm) in diameter. Although primarily illustrated with respect to an outer case 70, an inner case 70' (FIG. 4B) with a flange 82' that extends radially inboard and has partial scallops 180 on an inner diameter will also benefit herefrom.

Each scallop 150 extends for the entire thickness of the radial flange portion 148 and, in one example, defines a radius of about 0.25 inch (6.35 mm). That is, the scallop 150 is of a most generous radius related to the number of apertures and space therebetween to provide a desired web thickness. The radial flange portion 148 further includes a partial scallop 180 along an inner diameter 190 of the radial flange portion 148 to flank each aperture 122. This further facilitates a reduction of the stress on the flange 82.

Figure 5:
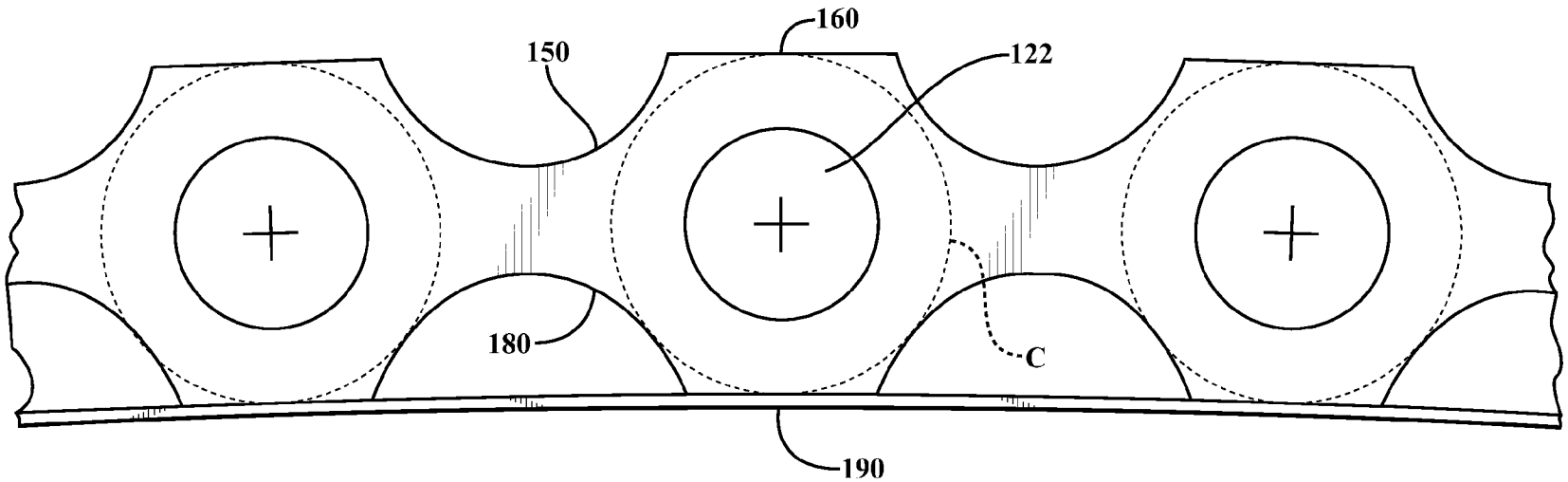
FIG. 5 is a face view of a flange.

Each partial scallop 180 is about half the thickness of the radial flange portion 148. As defined herein, "partial" refers to the partial scallop 180 that does not extend through the entirety of the thickness of the radial flange portion 148. Each partial scallop 180, in one example, also defines a radius of about 0.25 inch (6.35 mm). In one example, the generosity of the scallop 150, and the partial scallop 180, may be sized to form a circle "C" that surrounds the aperture 122 and extends from the outer diameter 160 to the inner diameter 190 (FIG. 5). That is, a web thickness around the aperture 122 in the radial flange is approximately equivalent with respect to the inner diameter 190, the outer diameter 160, the partial scallops 180 and the scallops 150. It should be appreciated that various other radiuses may be provided.

An inner scallop fillet radius 186, in one example, is about 0.25 inch (6.35 mm) is also formed from a face 192 of the radial flange portion 148 (also shown in FIG. 6 and FIG. 7). The inner scallop fillet radius 186 is also provided as a generous radius that, in one example, is about 0.5 that of the depth of the partial scallops 180. That is, the inner scallop fillet radius 186 is a relatively large transition to minimize stress formations and may essentially form a semi-spherical shape. The partial scallops 180, readily increase Low Cycle Fatigue (LCF) life of the apertures 122.

Figure 8:
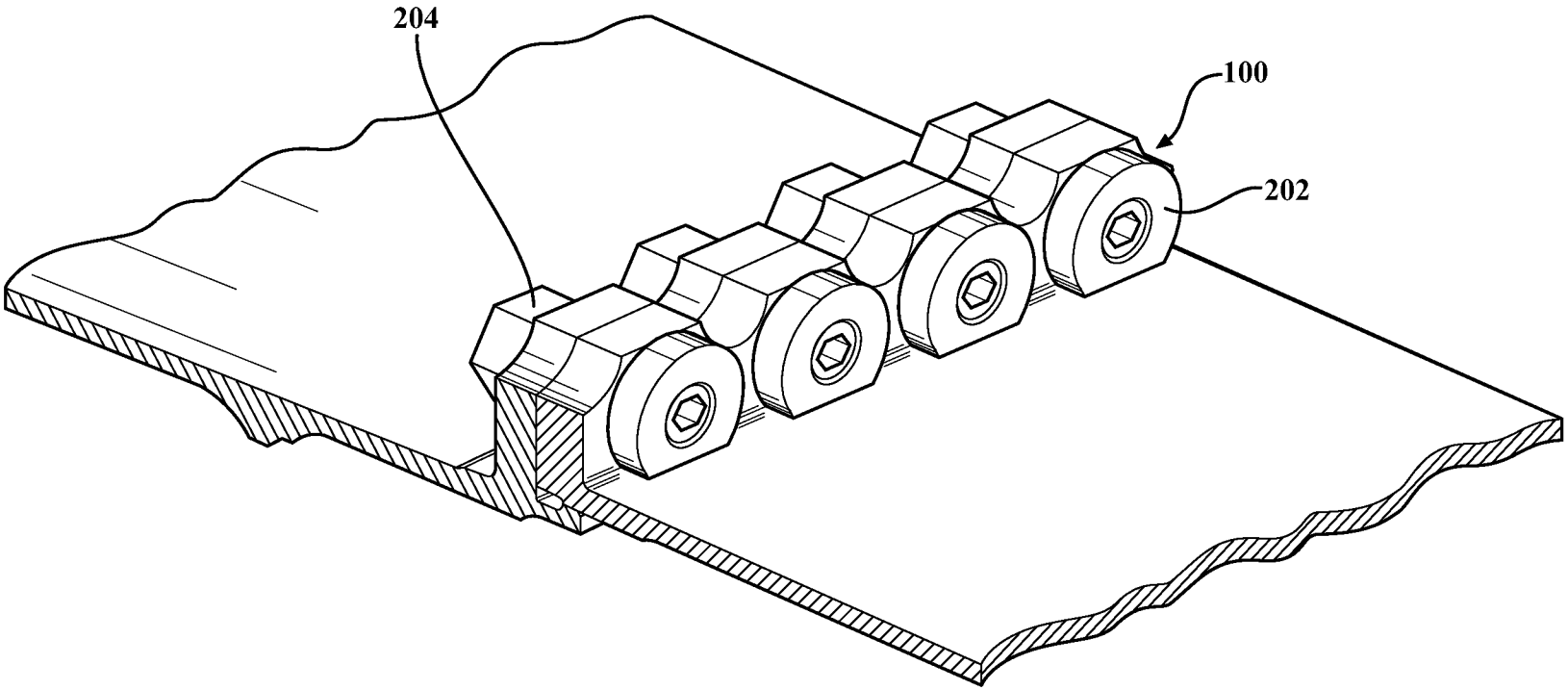
FIG. 8 is a sectional top view of the flange joint.

With reference to FIG. 8, the apertures 120, 122 receives the respective fastener 100 that, in one example, includes a "D" head bolt 202 that is 0.3125" (7.9 mm) in diameter. The "D" head bolt 202 facilitates a reduced radial height of the radial flange portions 140, 148 and operates as an anti-rotation feature to facilitate receipt and removal of a nut 204.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A case for a gas turbine engine, comprising:

a radial flange with a partial scallop; and a scallop along an outer diameter of the radial flange, the scallop forms a radius of 0.25 inch (6.35 mm), wherein a circle defined around an aperture in the radial flange tangentially interfaces with the inner diameter of the radial flange, the outer diameter of the radial flange, the partial scallop, and the scallop.

2. The case as recited in claim 1, wherein the partial scallop is along an inner diameter of the radial flange of an outer engine case.

3. The case as recited in claim 1, wherein the partial scallop is along an outer diameter the radial flange of an inner engine case.

4. The case as recited in claim 1, wherein the partial scallop forms a radius of 0.25 inch (6.35 mm).

5. The case as recited in claim 1, wherein the partial scallop forms an inner radius of 0.25 inch (6.35 mm) formed from a face of the radial flange portion.

6. The case as recited in claim 1, wherein a web thickness around an aperture in the radial flange is equivalent with respect to the inner diameter of the radial flange, the outer diameter of the radial flange, the partial scallop and the scallop.

7. A case assembly for a gas turbine engine, comprising:

a first case with an a first radial flange with a partial scallop along an inner diameter of the first radial flange, the partial scallop adjacent to a first aperture through the first radial flange, wherein a web thickness around an aperture in the first radial flange is equivalent with respect to the inner diameter of the first radial flange, an outer diameter of the first radial flange, and the partial scallop;

a scallop along an outer diameter of the radial flange; and a second case with a second radial flange with a second aperture through the second radial flange, the second radial flange mountable to the first radial flange at an interface such that the second aperture is axially aligned with the first aperture and a seal lip that extends from the second case interfaces with said first case at a longitudinal interface.

8. The case assembly as recited in claim 7, wherein the seal lip that extends from the second case includes an undercut adjacent to the longitudinal interface.

9. The case assembly as recited in claim 7, wherein the scallop forms a radius of 0.25 inch (6.35 mm).

10. The case assembly as recited in claim 9, wherein the partial scallop forms a radius of 0.25 inch (6.35 mm).

11. The case assembly as recited in claim 10, wherein the partial scallop forms an inner radius of 0.25 inch (6.35 mm) formed from a face of the radial flange portion.

12. A case assembly for a gas turbine engine, comprising:

a first case with a first radial flange with a partial scallop along an inner diameter of the first radial flange, the partial scallop adjacent to a first aperture through the first radial flange; and a second case with a second radial flange with a second aperture through the second radial flange, the second radial flange mountable to the first radial flange at an interface such that the second aperture is axially aligned with the first aperture and a seal lip that extends from the second case interfaces with said first case at a longitudinal interface, wherein a circle defined around the first aperture in the first radial flange tangentially interfaces with the inner diameter of the radial flange, the outer diameter of the radial flange, and the partial scallop.

13. The case assembly as recited in claim 7, further comprising a heat shield that includes a distal end that interfaces with a step in the first case forward of the radial flange interface.

14. The case assembly as recited in claim 7, further comprising a fastener with a "D" head that is received through the first and second aperture.

* * * * *